US005084594A

United States Patent [19]

Cady et al.

[11] Patent Number: 5,084,594

[45] Date of Patent: Jan. 28, 1992

[54] MULTIWIRE CABLE

[75] Inventors: James W. Cady, Shelburne; John P. Barr, Jr., Ferrisburg, both of Vt.

[73] Assignee: Arrowsmith Shelburne, Inc., Shelburne, Vt.

[21] Appl. No.: 563,487

[22] Filed: Aug. 7, 1990

[51] Int. Cl.[5] ..... H01B 7/08; H01B 7/34

[52] U.S. Cl. ..... 174/36; 174/117 F; 174/117 M

[58] Field of Search ..... 174/36, 117 M, 70 TR, 174/117 F

[56] References Cited

U.S. PATENT DOCUMENTS

| | | | |
|---|---|---|---|
| 304,759 | 9/1884 | Shaffer | 174/117 M |
| 3,430,337 | 3/1969 | Kelly | 156/54 X |
| 3,495,025 | 2/1970 | Ross | 174/70 R |
| 3,627,903 | 12/1971 | Plummer | 174/72 A |
| 3,646,247 | 2/1972 | Sennett | 174/117 M |
| 3,694,563 | 9/1972 | Monds et al. | 174/97 |
| 3,798,346 | 3/1974 | Kreuzer | 174/15 C |
| 4,096,346 | 6/1978 | Stine et al. | 174/36 |
| 4,159,394 | 6/1979 | Ross | 174/72 TR |
| 4,234,759 | 11/1980 | Harlow | 174/104 |
| 4,375,379 | 3/1983 | Luetzow | 174/72 TR X |
| 4,409,427 | 10/1983 | Plummer, III | 174/36 |
| 4,551,576 | 11/1985 | Rich | 174/36 |
| 4,564,723 | 1/1986 | Lang | 174/36 |
| 4,808,771 | 2/1989 | Orr, Jr. | 174/72 TR |
| 4,818,820 | 4/1989 | LaRock | 174/36 |

FOREIGN PATENT DOCUMENTS

| | | | |
|---|---|---|---|
| 5468 | 12/1881 | United Kingdom | 174/36 |

OTHER PUBLICATIONS

Steve Hunter et al., "The Application Specific Connector: Communications", *Connection Technology*, Apr. 1990, pp. 43–45.

*Primary Examiner*—Morris H. Nimmo
*Attorney, Agent, or Firm*—Pretty, Schroeder, Brueggemann & Clark

[57] ABSTRACT

A low cost high signal frequency multiwire cable and method of manufacture includes a stack of wire pairs fan folded from a flat ribbon cable to form columnated wire pair layers. The flat ribbon cable is folded together with a flexible conductive shield which extends around and between each layer to provide high quality signal isolation of each layer. The cable may be clad with multiple layers providing additional shielding and physical protection.

22 Claims, 3 Drawing Sheets

MULTIWIRE CABLE

BACKGROUND OF THE INVENTION

With the advances that have been made in semiconductor technology in recent years, extremely complex electrical circuits can be manufactured relatively inexpensively. As a result these circuits are assembled into more and more complex components. As the components become more complex, the demands for signal communication among them tend to increase in terms of the number of signals required and the frequency of the signals.

The electrical cables providing communication between different electronic components have thus tended to become increasingly expensive. One technique that has been developed to decrease the cost and manageability of multiple wire connections is flat ribbon cables. Such cables maintain the individual wires in fixed relationship to one another so that they can be handled as a single unit and so that any given wires can be readily selected and distinguished from other wires.

A known technique for making flat ribbon cables is to use a woven mesh to secure the wires in a fixed relationship. U.S. Pat. No. 4,818,820 to LaRock and U.S. Pat. No. 4,159,394 to Ross disclose arrangements in which a flat ribbon cable is formed as a woven web. LaRock increases the number of wires by using a double layer of flat ribbon cables with the two layers being separated by a copper sheet.

U.S. Pat. No. 4,808,771 to Orr, Jr. and U.S. Pat. No. 3,495,025 to Ross teach further arrangements of flat woven wire cable in which three sections of a woven mesh cable are fan folded with the mesh extending in serpentine fashion to form a multilayer cable. While these arrangements provide a compact physical configuration, there is no shielding of the wires carried by the cable and the frequency of signals communicated over the cable is limited because of cross coupling between different conductors within the cable.

Other arrangements are known wherein insulation material extends between adjacent wires to maintain the wires in fixed relationship to one another and form a flat ribbon cable. See, for example, Steve Hunter et al., "The Application Specific Connector: Communications", *Connection Technology*, April 1990, pp. 43–45; U.S. Pat. No. 4,234,759 to Harlow, U.S. Pat. No. 4,375,379 to Luetzow, and U.S. Pat. No. 4,564,723 to Lang and U.S. Pat. No. 3,798,346 to Kreuzer.

U.S. Pat. No. 3,694,563 to Monds et al. teaches an arrangement in which an insulated metal conduit maintains the individual wires in fixed relationship to one another. U.S. Pat. No. 3,430,337 to Kelly discloses the use of a noninsulated metal shield.

In view of the ever growing complexity of electrical and electronic components and the signals that must be communicated between different components, a continuing need exists for low cost, multiple wire cable systems that can carry a large number of independent, high frequency signals. This invention provides electrical cables and a method of manufacture that results in an improved ratio of performance to cost.

SUMMARY OF THE INVENTION

A high signal frequency, low cost electrical cable in accordance with the invention includes a multilayer stack of insulated electrical wire pairs, a woven mesh securing the individual wires in positional relationship to one another, and an electrically conductive shield disposed between adjacent layers. The woven mesh extends through each separate layer and extends in serpentine fashion between pairs of adjacent layers.

A cable in accordance with the invention is advantageously manufactured by weaving a plurality of insulated wires into a flat ribbon cable having a plurality of wire groups, sheathing the woven flat ribbon cable with a flexible conductive shield such as copper foil, securing the shield to the cable between wire groups on both sides thereof, and fan folding the wire groups and conductive shield into a multilayer stack with each layer containing a different one of the wire groups and with the conductive shield being folded together with the wire groups such that a portion of the conductive shield extends between each layer of the stack.

Alternatively, the woven mesh flat cable can be fan folded into a multilayer stack without the interlayer shielding. Precut strips of conductive shielding can then be inserted between pairs of adjacent layers after the ribbon has been folded into a multilayer stack. In this arrangement the shielding does not extend completely around all of the layers of the stack and is somewhat less effective.

After the stack is formed it is preferably clad with successive layers of Mylar insulation, overbraid conductive shielding and heat shrink insulation tubing to provide further electrical shielding and physical protection of the cable. Multiple stacks may be arranged in side-by-side opposed relationship with a conductive shield between prior to application of the outer cladding in order to increase the number of wires in the cable. In a preferred embodiment each layer of the stack consists of two wires which can be used as a substitute for a twisted wire pair having an increased performance characteristic that approaches that of a shielded twisted pair.

BRIEF DESCRIPTION OF THE DRAWINGS

A better understanding of the invention may be had from a consideration of the following Detailed Description, taken in conjunction with the accompanying drawings in which.

DETAILED DESCRIPTION OF THE INVENTION

Figure 1:
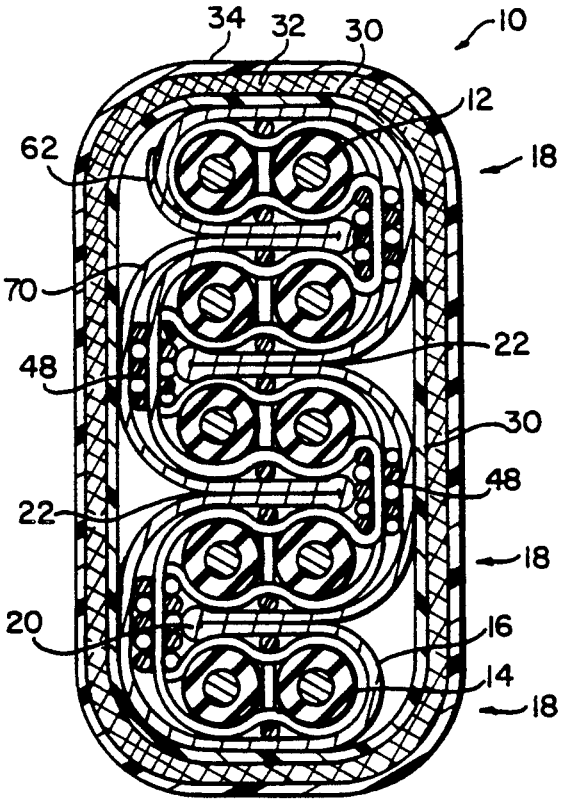
FIG. 1 is a sectional end view of a high frequency, low cost multiwire cable in accordance with the invention.

Referring now to FIG. 1, a low cost, high quality multiwire flexible electrical cable 10 in accordance with the invention includes a multilayer stack 12 of insulated electrical wires 14. A flexible conductive shield 16 extends about each layer 18 of wires 14 and includes a portion 20 which extends as a fold 22 between each adjacent pair of wire layers 18. In the disclosed arrangement there are five layers of wires 14 separated by four conductive shield folds 22 although it will be appreciated that a larger or smaller number of layers could be included in the stack 12.

In the preferred arrangement each layer 18 of stack 12 contains two wires 14 which form an electrically shielded wire pair. Each shielded wire pair may be used as a high quality substitute for a conventional twisted wire pair which would typically carry a differential mode electrical signal. Because of the fixed relationship construction and the effective shielding, the wire pairs of each layer 18 provide better high frequency electrical characteristics, less cross talk with adjacent wires and less coupling of unwanted electrical noise than a conventional twisted wire pair. The quality of each shielded pair approaches that of coaxial cable.

The completed stack 12 is further encapsulated with an insulating layer of Mylar film 30, an overbraid conductive shield 32 which may be braided from copper strands and an outer protective layer of heat shrinkable tubing 34. The outer layer 34 provides both electrical insulation and environmental protection.

Figure 2:
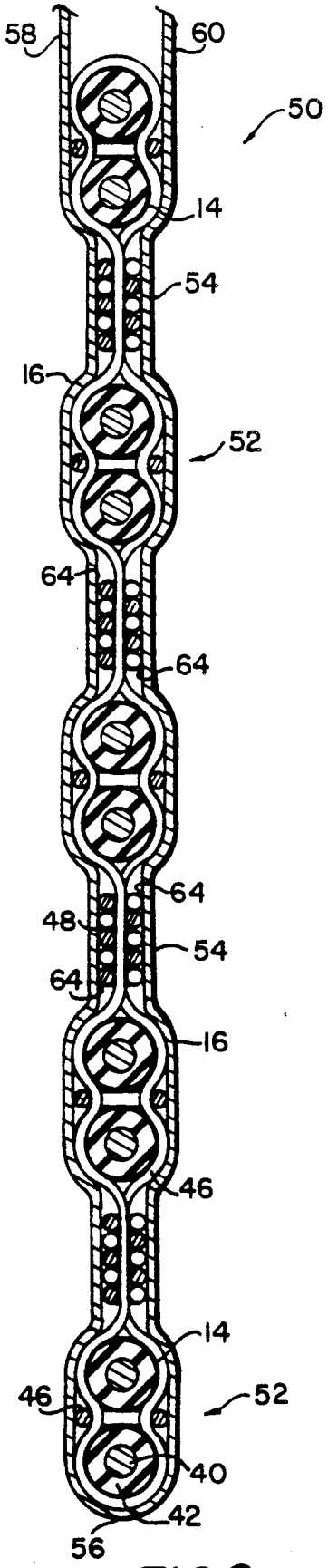
FIG. 2 is a sectional end view of a shielded flat ribbon cable at an intermediate point in the manufacture of the cable shown in FIG. 1.

Making further reference now to FIG. 2, each wire 14 is a conventional insulated electrical wire having a center conductor 40 and at least one concentric layer of insulation 42. In one example, wire 14 has a center conductor 40 of multistrand tin coated copper surrounded by three layers of insulation and shield. The layer of shielding is sandwiched between two layers of insulation. Such a wire is described by Military Specification MIL-C-85485 dated Apr. 25, 1986. Other kinds of insulated wire may of course be used for the wire 14.

One or more strands or threads 46 are woven together with the wires 14 to form a fabric mesh 48 that encompasses each of the wires 14 to positionally fix the wires 14 relative to each other and form a flat ribbon cable 50 having ten individual wires 14. The woven mesh 48 serves to maintain the wires 40 in a flat coplanar relationship to one another.

Techniques for weaving the wires 14 into a planar mesh 48 to form cable 50 are well known. The cable 50 is available from several commercial sources including Textro Corporation in Houston, Texas. A preferred material for the strands or threads 46 is commercially available under the name Nomex. Various other fiber weave configurations may be used to make the cable 50.

The wires 14 are arranged in a plurality of wire groups 52. In the present preferred example, each group 52 contains two wires 14. The wires 14 of each group 52 are closely spaced although the typical weaving process requires at least one strand 46 to pass between each adjacent pair of wires 14.

A greater space 54 is provided between each adjacent pair of wire groups 52 to serve as a fold line. The space 54 should have sufficient length to allow fan folding therealong so that one wire group 52 on one side of a space 54 can be folded into opposed stacked relationship with an adjacent group 54 on an opposite side of the space 52. In one arrangement using No. 22 wire, spaces 52 having a length of approximately 3 mm were found to be sufficient.

The cable 50 is provided in a long, virtually continuous roll or reel and is cut to a desired length to match a required application. A sheet of flexible conductive shielding material 16 such as copper fail is cut to substantially the same length and wrapped about the ribbon cable 50 in a close fitting substantially U-shaped pattern. The shield 16 covers both sides of cable 50 and is closely wrapped around the bottom or outer conductor 14 at the trough of the U 56. The open, upper edges 58, 60 of shield 16 and the portion of shield 16 adjacent thereto are folded into overlapping relationship at overlap 62 (FIG. 1) so that conductive shield 16 passes completely around the periphery of flat ribbon cable 50. The overlap 62 may be made either before or after the fan folding of cable 50 along the fold spaces 54.

It is preferred that a bonding agent 64 such as a fast setting epoxy be applied to the fabric weave defining the fold spaces 54 on both sides thereof prior to placement of conductive shield 16. After placement of shield 16 a stylus, wheel or other suitable instrument may be run along the lines of spacers 54 to force shield 16 into contact with the previously applied bonding agent 64 and secure shield 16 to the fabric defining the spaces 54.

After the bonding agent 64 is cured and the shield 16 is secured to the woven fabric of spacers 54, the cable 50 is fan folded along the lines of spacers 54 to place the wire groups 52 in a stack with immediately adjacent groups on the opposite side of each space 54 being in opposed relationship to each other. Each wire group 52 thus becomes a different layer 18 in the stack 12.

The shield 16 is folded together with the wire groups 52 of cable 50 such that a portion of cable 16 forms a fold 22 that extends in a double layer between each adjacent pair of stack layers 18. Opposite each fold 22 the shield 16 forms a double layer cover 70 that extends from below the lower stack layer 18 to above the upper stack layer 18. Each stack layer 18 is thus substantially completely electrically shielded from each immediately adjacent stack layer 18. Only a small path equal in thickness to the thickness of the fabric mesh 48 provides a leakage path for electromagnetic radiation between different layers of the stack 14.

Furthermore, if the bonding agent 64 is a conductive material such as conductive epoxy, this shielding gap is further constricted. The bonding agent 64 tends to enter the interstices of the woven mesh fabric 48 to provide a conductive extension of the shield 16 in the gap between each fold 22 and the opposite shield cover 70 to substantially completely enclose each layer 18 with a conductive shield.

It will be noted that after the cable 50 has been fan folded to form the stack 14, the woven fabric 48 continues through each layer 18 to secure the wires 40 of each layer 18 in a fixed positional relationship. The fabric 48 further extends in serpentine fashion between opposite layer 18 by passing between successive adjacent layers alternately on the left side of the stack and then the right side of the stack 14, starting at the bottom and moving upward.

Figure 3:
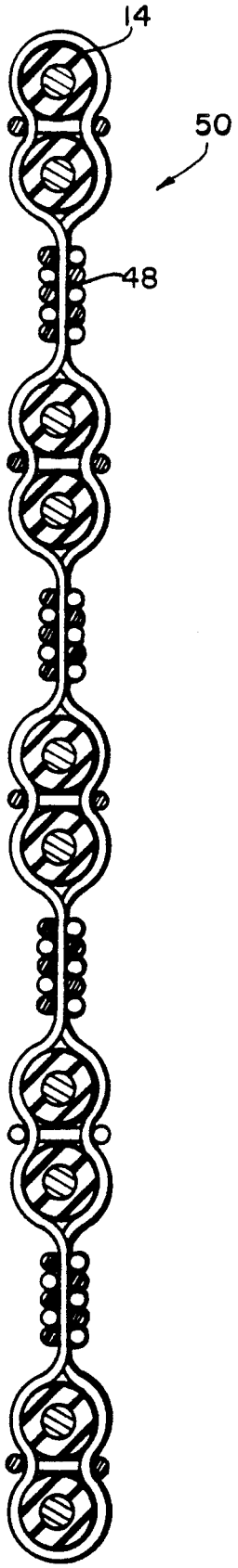
FIG. 3 is a sectional end view of a multiwire flat ribbon cable used in an alternative embodiment of the invention.
Figure 4:
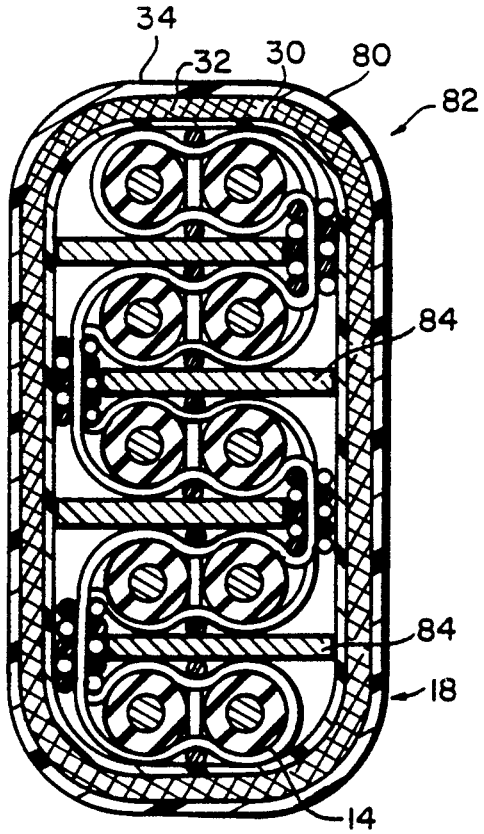
FIG. 4 is an alternative embodiment of a multiwire, multilayer shielded cable in accordance with the invention using the flat ribbon cable shown in FIG. 3.
Figure 5:
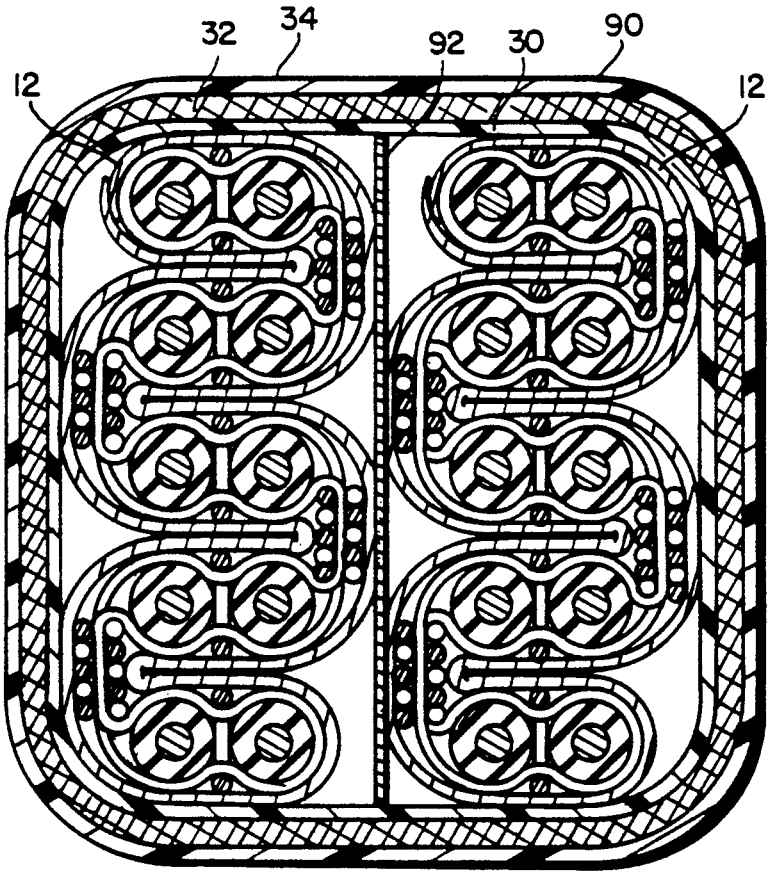
FIG. 5 is an alternative embodiment of a cable in accordance with the invention having two side-by-side shielded stacks of multilayer insulated wire pairs in accordance with the invention.

Referring now to FIGS. 3 and 4 an alternative embodiment of a cable 80, the invention begins with the same woven fabric flat ribbon 50 as the cable 10. Cable 50 is fan folded without first applying a conductive shield to form a stack 82 having a plurality of columnar aligned stack layers 18. A plurality of elongated conductive strip shields are cut in length substantially equal to the wires 14 and in width slightly greater than the width of the conductors 14 forming each layer 18 of stack 82.

While the cable 80 does not provide the substantially complete electrical isolation of each layer 18, the conductive strip shields 84 do provide excellent electric shielding between adjacent layers 18. The cable 80 is clad with layers of Mylar 30, an overbraid shield 32 and heat shrink tubing 34 in a manner similar to the cable 10. The overbraid shield 32 functions in conjunction with the interlayer shields 84 to provide excellent shielding of each layer 18 from the surrounding environment as well as adjacent layers 18.

A still further embodiment of a cable 90 in accordance with the invention includes two of the stacks 12 (or 82) disposed in side-by-side opposed relationship and separated by a planar conductive shield 92 of a material such as copper foil. The cable 90 effectively doubles the number of conductors while maintaining the same high quality signal carrying capacity as the cables 10 or 80.

Cable 90 is clad with layers of Mylar 30, overbraid shield 32 and heat shrink tubing 34 in a manner similar to cables 10 and 80. The cladding layers 30, 32 and 34 serve to bind the one or more stacks 12 (or 82) into a single cohesive unit to form a cable 10, 80 or 90. Alternative cladding configurations could of course be used, but the disclosed arrangement provides excellent electrical and physical isolation at a reasonable cost and is therefore preferred.

While there have been shown and described above various arrangements of multiwire electrical cables and methods of manufacture in accordance with the invention for the purpose of enabling a person of ordinary skill in the art to make and use the invention, the invention is not limited thereto. Accordingly, any modifications, variations or equivalent arrangements within the scope of the attached claims should be considered to be within the scope of the invention.

What is claimed is:

1. An electrical cable comprising:

a multilayer stack of insulated electrical wires, each layer having two opposite sides and having at least two of the wires therein;

a woven mesh securing together all of the wires in the stack, the mesh extending through each layer and extending in serpentine fashion from layer to layer; and a conductive shield extending about the stack of insulated electrical wires, the shield extending along the opposite sides of each layer by extending in serpentine fashion between each adjacent pair of layers in the stack.

2. An electrical cable according to claim 1 further comprising:

a second multilayer stack of insulated electrical wires, each layer having two opposite sides and having a plurality of wires therein, the second stack being disposed in opposed side-by-side relationship to the first mentioned stack;

a second woven mesh securing together all of the wires of the second stack, the second woven mesh extending through each layer and extending in serpentine fashion from layer to layer in the second stack;

a conductive shield extending about the insulated electrical wires in the second stack, the conductive shield extending along the opposite sides of each layer by extending in serpentine fashion between each adjacent pair of layers in the second stack;

a conductive shield disposed between the first mentioned and second stacks; and a binding securing the first mentioned and second stacks in side-by-side relationship to one another.

3. An electrical cable according to claim 1 further comprising means circumscribing the stack for binding the stack into a single cohesive unit.

4. An electrical cable comprising:

A multilayer stack of insulated electrical wires, each layer having at least two of the wires therein;

a woven mesh securing together all of the wires in the stack, the mesh extending through each layer and extending in serpentine fashion from layer to layer; and a conductive shield disposed between each adjacent pair of layers, the shield comprising a single unitary piece of flexible conductive material wrapped completely about the stack of electrical wires, the shield being folded with each layer to provide a portion which extends between each pair of adjacent layers.

5. An electrical cable according to claim 4 wherein the shield comprises a sheet of copper foil.

6. An electrical cable according to claim 4 further comprising a bonding agent disposed to secure a trough of each fold of the conductive shield between layers to the woven mesh.

7. An electrical cable according to claim 6 wherein said bonding agent is a conductive bonding agent.

8. An electrical cable according to claim 6 further comprising successive layers of insulation, conductive shielding and insulation extending about the stack and forming an outer cladding for the cable.

9. An electrical cable comprising:

a multilayer stack of insulated electrical wires, each layer having at least two of the wires therein;

a woven mesh securing together all of the wires in the stack, the mesh extending through each layer and extending in serpentine fashion from layer to layer;

a conductive shield disposed between each adjacent pair of layers;

a second multilayer stack of insulated electrical wires, each layer having a plurality of wires therein the second stack being disposed in opposed side-by-side relationship to the first mentioned stack;

a second woven mesh securing together all of the wires of the second stack;

a conductive shield disposed between each adjacent pair of layers of the second stack;

a conductive shield disposed between the first mentioned and second stacks; and a binding securing the first mentioned and second stacks in side-by-side relationship to one another.

10. An electrical cable according to claim 9 wherein the binding comprises successive layers of insulation, conductive shielding and insulation.

11. An electrical cable comprising:

a plurality of electrical conductor wire pairs, each wire including a center conductor surrounded by insulation, the wires being woven into multiwire cable having a greater spacing between adjacent wires in different adjacent pairs than between adjacent wires in the same pair; a conductive foil shield enclosing the cable and extending in close proximity to the wire pairs on two sides thereof; the cable and conductive shield being folded along fold lines extending between adjacent wire pairs to provide a columnated stack of wire pairs with the conductive foil shield being folded together with the conductor wire pairs to provide conductive shielding between and around each adjacent pair of wires in the cable.

12. An electrical cable comprising:

a stack of electrically insulated electrical wire pairs;

a woven mesh securing the wires of the stack together to form a cable, the woven mesh securing together the individual wires of each wire pair and extending in serpentine fashion between wire pairs to secure each wire pair to all adjacent wire pairs; and a continuous conductive foil wrapped about the pairs of wires in the stack, the foil extending between each two adjacent wire pairs to provide electrical isolation of each wire pair from any other immediately adjacent wire pair in the stack.

13. An electrical cable comprising:

a stack of electrically insulated electrical wire pairs;

a woven mesh securing the wires of the stack together to form a cable, the woven mesh securing together the individual wires of each wire pair and extending in serpentine fashion between wire pairs to secure all of the wire pairs into a single, continuous cable; and a conductive foil wrapped about the pairs of wires in the stack, the foil extending between each two adjacent wire pairs to provide electrical isolation of each wire pair from any other immediately adjacent wire pair in the stack; and a conductive bonding agent securing the conductive foil to the woven mesh at an extremity of the extent of the foil between each two adjacent wire pairs.

14. An electrical cable comprising:

a multilayer stack of electrically insulated electrically conductive wires each layer having a plurality of the wires therein, the conductive wires being woven together by a woven mesh that extends through each separate layer in serpentine fashion to secure an edge of each layer to an edge of an adjacent layer; and an electrically conductive foil wrapped about the stack of wires and extending continuously in serpentine fashion between adjacent layers to provide electrical isolation between each occurrence of two adjacent layers.

15. An electrical cable according to claim 14 further comprising a cladding extending about the stack.

16. An electrical cable comprising;

a multilayer stack of insulated electrical wires, each layer having a plurality of the wires arranged in a plane;

a fabric mesh interwoven with the electrical wires and securing the wires in positional relationship to each other, the fabric extending through each layer and in serpentine fashion from one layer to a next adjacent layer; and a flexible conductive shield extending about the stack of wires with a portion of the shield extending in continuous serpentine fashion between each adjacent pair of layers to electrically shield each layer from any adjacent layer.

17. A method of manufacturing an electrical cable comprising the steps of:

weaving a plurality of insulated electrical wires into a flat ribbon cable having a plurality of wire groups, each wire group including a plurality of the electrical wires;

sheathing the woven flat ribbon cable with a flexible conductive shield; and folding the wire groups and conductive shield into a multilayer stack with each layer containing a different one of the wire groups and with the conductive shield being folded together with the wire groups such that a portion of the conductive shield extends between each layer of the stack.

18. A method of manufacturing according to claim 17 further comprising the step of cladding the multilayer stack with at least one layer of protective material.

19. A method of manufacturing according to claim 17 further comprising the step of peripherally binding the stack to form a cohesive unit.

20. A method of manufacturing according to claim 17 further comprising the step of cladding the stack with successive layers comprising insulation, conductive shielding and insulation.

21. A method of manufacturing an electrical cable comprising the steps of:

weaving a plurality of insulated electrical wires into a flat ribbon cable having a plurality of wire pairs;

sheathing the woven flat ribbon cable with a flexible conductive shield; and folding the wire pairs and conductive shield into a multilayer stack having one wire pair in each layer and with the conductive shield being folded together with the wire pairs such that a portion of the shield extends between each layer of the stack to electrically shield each wire pair from any adjacent wire pair.

22. A method of manufacturing an electrical cable comprising the steps of:

securing a plurality of insulated electrical wires into a coplanar relationship using at least one elongated strand to form a flat ribbon cable, the wires being divisible into a plurality of wire groups, each including a continuous plurality of the wires;

sheathing the flat ribbon cable with a flexible conductive shield;

securing the shield to the at least one strand at at least one position between each adjacent pair of wire groups; and folding the wire groups and conductive shield into a multilayer stack having one wire group in each layer and with the conductive shield being folded together with the wire pairs such that a portion of the shield extends between each layer of the stack.

* * * * *